United States Patent [19]

Yabe et al.

[11] Patent Number: 4,471,833

[45] Date of Patent: Sep. 18, 1984

[54] AUGMENTATION METHOD OF BOILING HEAT TRANSFER BY APPLYING ELECTRIC FIELDS

[75] Inventors: Akira Yabe, Toride; Takao Taketani, Ibaraki; Kentaro Kikuchi, Tokyo, all of Japan

[73] Assignees: Agency of Industrial Science & Technology; Ministry of International Trade & Industry, both of Tokyo, Japan

[21] Appl. No.: 411,425

[22] Filed: Aug. 25, 1982

[30] Foreign Application Priority Data

Aug. 31, 1981 [JP] Japan ..... 56-136335

[51] Int. Cl.[3] ..... F28F 13/16

[52] U.S. Cl. ..... 165/1; 62/527; 165/109 R

[58] Field of Search ..... 165/1, 109 R, 133; 62/527; 204/147, 196

[56] References Cited

U.S. PATENT DOCUMENTS

| | | | |
|---|---|---|---|
| 3,301,314 | 1/1967 | Gaertner | 165/1 |
| 3,370,644 | 2/1968 | Daily et al. | 165/1 |
| 3,433,294 | 3/1969 | Timson | 165/1 |
| 3,448,791 | 6/1969 | Clark | 165/1 |
| 3,490,520 | 1/1970 | Delaney et al. | 165/1 |
| 3,696,861 | 10/1972 | Webb | 165/1 |
| 3,951,207 | 4/1976 | Baumann et al. | 165/133 |

FOREIGN PATENT DOCUMENTS

| | | | |
|---|---|---|---|
| 1501367 | 5/1967 | Fed. Rep. of Germany | 165/1 |
| 2244331 | 9/1972 | Fed. Rep. of Germany | 165/133 |
| 438863 | 1/1975 | U.S.S.R. | 165/1 |
| 549677 | 4/1975 | U.S.S.R. | 165/1 |
| 635390 | 11/1978 | U.S.S.R. | 165/1 |

OTHER PUBLICATIONS

SN 396,118 filed 9-10-73, now abandoned, referred to in U.S. Pat. No. 3951207.

"The Effect of Applied Voltage on Boiling Heat Transfer", By M. Markels, Jr. and R. Durfee, A.I.CH.E. Journal vol. 10, No. 1.

Effect of an Electric Field on Boiling Heat Transfer", by R. L. Johnson, A.I.A.A. Journal, vol. 6, No. 8, pp. 1456-1460.

*Primary Examiner*—Sheldon J. Richter

*Attorney, Agent, or Firm*—Schwartz & Weinrieb

[57] ABSTRACT

A method for promoting a boiling heat transfer by applying an electric field to a heat exchange medium, comprises making the relaxation time of an electric charge of a heat exchange medium used equal to or smaller than the characteristic time with respect to motion of bubbles generated by the heat transfer surface in the heat exchange medium to maximize the maximum boiling heat flux.

4 Claims, 14 Drawing Figures

AUGMENTATION METHOD OF BOILING HEAT TRANSFER BY APPLYING ELECTRIC FIELDS

FIELD OF THE INVENTION

The present invention relates to a method for increasing boiling heat transfer by applying electric fields.

BACKGROUND OF THE INVENTION

Electric power generation utilizing small temperature differences is important to the promotion of energy conservation. In this case it is necessary to use a boiling heat exchanger with high performance because, due to the small temperature difference (less than 30° C.) between the heat source and the heat exchange medium, it is necessary to boil the medium by utilization of as small temperature difference as possible even in the case of a heat exchanger. To this end, a metal heat transfer surface with a complexly manufactured surface is used. However, although use of an enhanced boiling surface promotes nucleate boiling heat transfer over that obtainable with a smooth metal surface in the region of small temperature difference, it also causes a number of bubbles to be produced so that shift to film boiling occurs at a low temperature difference. This results in the shifting to film boiling in the vicinity of the inlet of the boiling heat exchanger to deteriorate the heat transfer performance. For this reason, it has been suggested that the transition to film boiling be delayed by applying an electric field.

More specifically, the boiling curve in boiling heat transfer is shown by the curve I in FIG. 1. That is, the curve I moves from the nucleate boiling region a to the peak $P_1$, maximum boiling heat flux, and when entering the film boiling region, the heat flux Q is abruptly lowered as shown at a'.

The entire quantity of heat transfer is increased in the present invention as shown by the boiling curve II, by promoting and augmenting the heat transfer in the nucleate boiling state and delaying the shift to film boiling. (The peak $P_2$ is the maximum boiling heat flux.) Although the boiling heat exchanger exhibits the highest temperature difference at its inlet and the lowest temperature difference at its outlet, high heat transfer performance must be caried out over the entire portion of the heat exchanger.

There have been proposed various methods for promoting boiling heat transfer, such as a method utilizing application of an elelctric field to a boiling surface, for example. It was, however, believed that the augmentation of the heat transfer by application of electric fields would merely bring about augmentation of the maximum boiling heat flux. In other words, it has been little known that the effects resulting from the shape of an electrode or a heat transfer surface contribute to augmentation of the heat flux in the nucleate boiling region and no one has taken heat exchange media into consideration.

The aforementioned method utilizing application of an electric field will be described with reference to FIG. 2.

High voltage is applied between a heat transfer surface 3 having its back held in contact with a medium 1 from which heat is to be transferred and electrode 4 in the shape of rods, plates, a net, or the like placed in a heat exchange medium 2, and an electric field is applied to the heat exchange medium 2 in the neighborhood of the heat transfer surface 3.

With this, the boiling curve I of FIG. 1 assumes the curve III and the maximum boiling heat flux is shifted from point $P_1$ to point $P_3$, and it is known that the maximum boiling heat flux is two to three times of the case wherein the electric field is not applied.

However, the conventional method for increasing the maximum boiling heat flux by the electric field merely contemplates the application of the high voltage to the heat transfer surface by means of the aforementioned electrodes and does not pay any attention to the optimization of other conditions. One of the reasons is that neither a physical mechanism for determining the maximum boiling heat flux by the electric field nor a theoretical analysis has been accomplished. With no theoretical analysis, it is difficult to obtain the factors for optimization, and there is no choice but to use of the voltage as the only factor.

SUMMARY OF THE INVENTION

It is an object of the present invention to provide a method of boiling heat transfer which theoretically analyzes the mechanism for increasing maximum boiling heat flux by an electric field to obtain a factor for optimization and simultaneously provides conditions for optimization thereby considerably increasing the heat flux in the nucleate boiling region by means of the electric field.

In order to achieve the aforementioned object, the present invention provides a method for promoting a boiling heat transfer by applying an electric field to a heat exchange medium, which method comprises the step of making the relaxation time of an electric charge of a heat exchange medium used equal to or smaller than the characteristic time with respect to motion of bubbles generated in the heat transfer surface by the heat exchange medium to maximize the maximum boiling heat flux.

BRIEF DESCRIPTION OF THE DRAWINGS

Other objects and features of the present invention will be apparent from the ensuing description in conjunction with the accompanying drawings, wherein.

DESCRIPTION OF THE PREFERRED EMBODIMENTS

There has not been established up to and including the present date, any definite theory with respect to or concerning any single or primary factor or factors for determining the maximum boiling heat flux within a heat exchange medium. The present inventors have proceeded to achieve a theoretical analysis on the assumption that the maximum boiling heat flux is determined by to instabilities produced in a gas-liquid interface.

Figure 1:
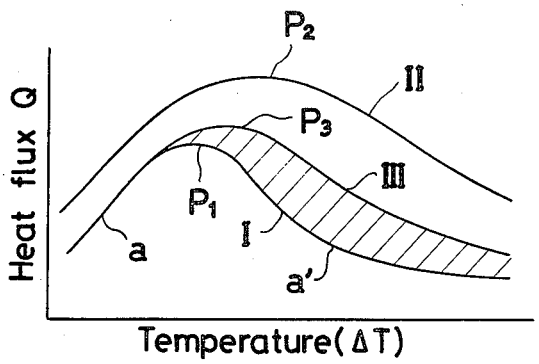
FIG. 1 is a graph showing the relationship between the heat flux and the temperature in boiling liquids.
Figure 2:
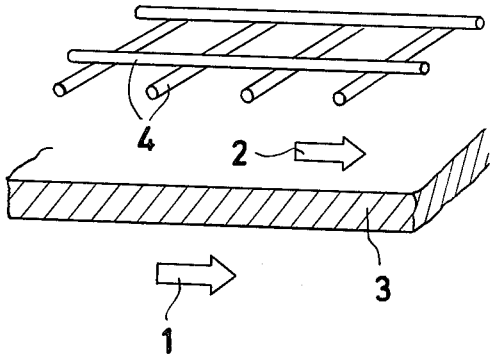
FIG. 2 is a schematic view of a known apparatus for boiling heat transfer by use of an electric field.
Figure 3A:
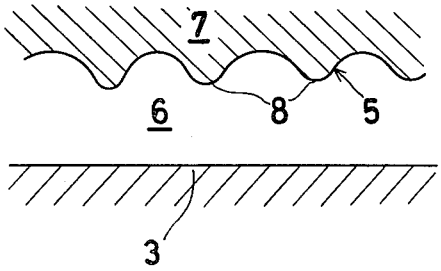
FIG. 3(A) illustrates an unstable state wherein a gas-liquid interface is parallel to the heat transfer surface.
Figure 3B:
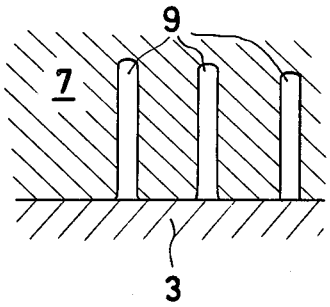
FIG. 3(B) illustrates a state wherein the gas-liquid interface is in the form of the maximum heat flux.

Among them, one is the instability of the gas-liquid interface parallel to the heat transfer surface, which will be described with reference to FIGS. 3(A) and 3(B). As shown in FIG. 3(A), when the quantity of boiling increases to temporarily cover a portion above the heat transfer surface 3 with a layer of vapor of a heat exchange medium, a layer of liquid 7 of the heat exchange medium is positioned above the layer of vapor 6. Therefore, a gas-liquid interface 5 assumes a corrugated form as shown, and when the instability occurs, valleys 8 in the corrugations of the gas-liquid interface 5 come closer toward the heat transfer surface 3 and finally the liquid of heat exchage medium comes in contact with the heat transfer surface 33. In this manner, as shown in FIG. 3(B), the vapors in the form of columns 9 are moved up from the heat transfer surface 3. This state shown in FIG. 3(B) is the state in the form of a maximum boiling heat flux. To increase the maximum boiling heat flux, the instability of the gas-liquid interface 5 is made to tend to occur.

Figure 4A:
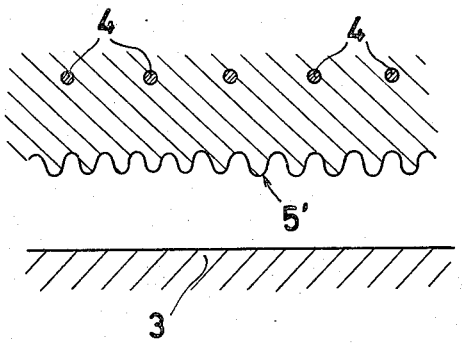
FIG. 4(A) illustrates an unstable state wherein the gas-liquid interface is parallel to the heat transfer surface in the case the electric field is applied.

When an electric field is applied with wire electrodes 4, the instability tends to occur in a gas-liquid interface 5' of the heat exchange medium as shown in FIG. 4(A), which is formed into a gas-liquid interface having a smaller wavelength than that of the gas-liquid interface 5 of FIG. 3. Therefore, a number of vapor columns 9' having a small diameter are produced above the heat transfer surface 3. The smaller the diameter of the vapor columns, the greater the heat flux will be. The diameter of the vapor column depends on the easiness of occurrence of the instability, and the easier the occurrence of the instability, the smaller the diameter will be. It is therefore considered that when the electric field is applied, the instability of the gas-liquid interface tends to occur, and the diameter of the vapor column is reduced to increase the maximum boiling heat flux.

As for one example, the result will be given of the measurement of the diameters of vapor columns in the case of electric field 0 and that of 20 kv/cm using Freon 113. In the case of electric field 0, the diameter was 25 mm, and in the case of electric field 20 kv/cm, the diameter was 8 mm. It is found from the aforesaid result that the maximum boiling heat flux is considerably increased.

Figure 4B:
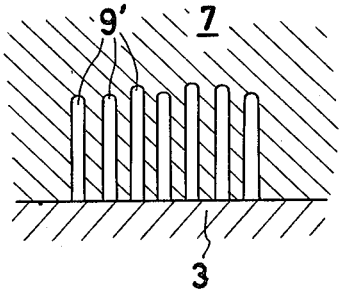
FIG. 4(B) illustrates a state wherein the gas-liquid interface is in the form of the maximum heat flux in the case the electric field is applied.
Figure 5A:
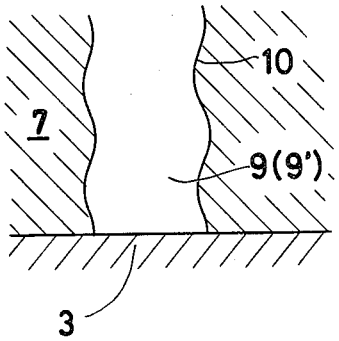
FIG. 5(A) illustrates an unstable state wherein the gas-liquid interface is perpendicular to the heat transfer surface.
Figure 5B:
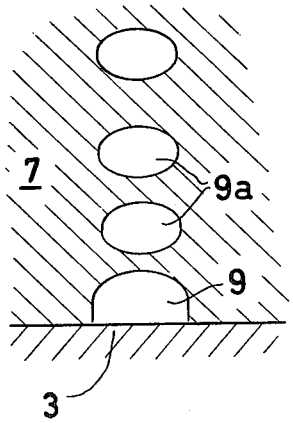
FIG. 5(B) illustrates a state wherein the unstable state in FIG. 5(A) is changed into a state of small bubbles.
Figure 5C:
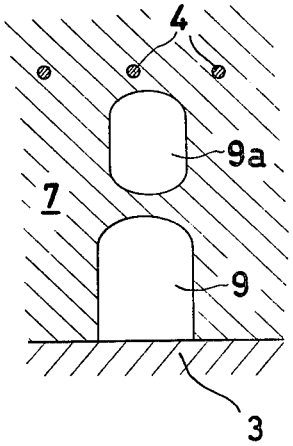
FIG. 5(C) illustrates a state wherein the unstable state in FIG. 5(A) is changed into a state of large bubbles.

The effect resulting from the instability of the parallel gas-liquid interface as described hereinbefore has been known to some extent (for example, AIAA JOURNAL Vol. 6, No. 8, p. 1456–1460, "Effect of an Electric Field on Boiling Heat Transfer"). However, the instability of the gas-liquid interface perpendicular to the heat transfer surface later described, that is, the instability of a vertical bubble jet is a factor which has not at all been studied. This is concerned with the instability of vapor columns 9(9')produced in FIGS. 3(B) and 4(B) as shown in FIG. 5(A), FIG. 5(B) and FIG. 5(C). In other words, this is a problem as to what degree the columns resulting from the aforesaid instability are stably retained and at what speed the vapors flow through the vapor columns.

First, as shown in FIG. 5(A), a vapor column 9(9') is produced on the heat transfer surface 3, but when the instability ocurs in a longitudinal gas-liquid interface 10 which forms the vapor column, the vapor column is successively cut from the foremost end thereof to form bubbles **9*a*, which are spearated from the vapor column 9. When the foremost end of the vapor column is successively separated as the bubbles, the growing speed of the vapor column, that is, the upwardly extending speed thereof becomes slow so that the critical boiling heat flux becomes small. It is therefore desirable that the longitudinal gas-liquid interface 10 is made to be stabilized to prevent the occurrence of instability. When the electric field is applied, the stability of the gas-liquid interface 10 increases and the vapor column becomes hard to be cut, as a consequence of which a relatively long vapor column 9 remains as shown in FIG. 5(C), and the bubble 9*a*** is also longitudinally elongated. With this, the upward speed of the vapor within the column increases and the critical boiling heat flux increases.

The theoretical analysis was made in the following with respect to the instability restraining effect by the electric field as described hereinbefore, and as a result, it can be verified in terms of experiments also. Thus, it becomes possible to select the factor for optimization.

Figure 6A:
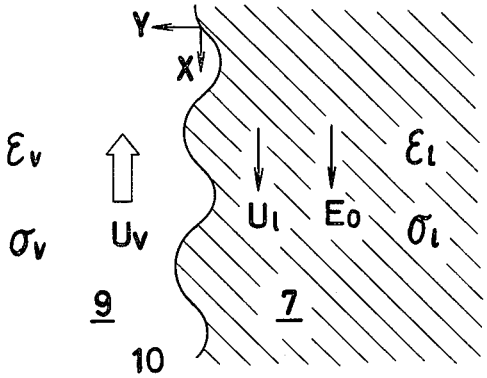
FIG. 6(A) is a theoretically analyzed view of the unstable state of the gas-liquid interface in FIG. 5(A).
Figure 6B:
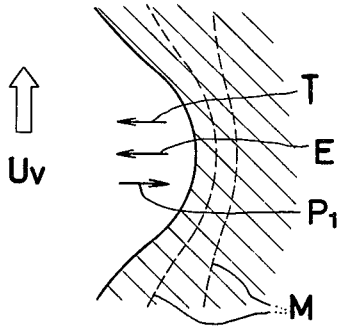
FIG. 6(B) is an enlarged view of an essential part of FIG. 6(A).

A description will be made with reference to FIGS. 6(A) and 6(B).

An analysis will be made of the stability of the vapor column in the electro-hydro-dynamics (EHD) field to which electric field is applied. It is assumed that:

(1) Centered vapor jet interfaces approximate each other in a two-dimensional interface.

(2) The conductivity $\sigma_v$ of vapor is considerably smaller than the conductivity $\sigma_l$ of liquid.

(3) The interface wave is approximated by the following formula.

$$\eta = B \cdot \sin k\,(x - ct)$$

($\eta$: Displacement in y direction, B: constant, k: number of waves, C: propagation speed)

(4) Fine interface wave is used. $\eta k \approx 0$ (5) Critical wavelength causing the instability is given by $$\lambda c = \pi \sqrt{\gamma/(\rho_l - \rho_v)g}$$

(g: gravity acceleration, $\rho_l$: density of liquid, $\rho_v$: density of vapor, $\gamma$: surface tension)

Here, the diameter of the vapor column is $\lambda c$, and with respect to the instability of the wavelength which is greater than the diameter, the instability would possibly result even if the surface tension alone is taken into consideration, and therefore, the vapor column $\lambda c$ is taken as the critical wavelength.

Under the assumption as described above, the instability of the interface wave produced in a two-phase interface having the relative speed will be discussed. Considering the balance of forces in the interface in this case, the force which tends to increase the instability of the interface is an increase $P_1$ (FIG. 6(B)) in static pressure as derived from Bernoulli's formula, by broadening of a flow passage, (or, a decrease in static pressure by narrowing of the flow passage). On the other hand, the force which tends to restrain the instability of the interface comprises the surface tension and the increased induction acting force resulting from the increase in the electric field. The reason for this increase is explained as follows and the magnitude thereof will be calculated later. Referring to the enlarged view in FIG. 6(B), the effect of the electric field is that since the lines of electric force M are narrowed by deformation of the interface, the intensity of the electric field increases and accordingly, the Maxwell stress, expressed as $(\frac{1}{2})(\epsilon_l-\epsilon_v)E^2$($\epsilon$=dielectric constant; E=intensity of the electric field) and constituting the force exerted upon the electric charge $(\epsilon_l-\epsilon_v)E$ generated on the interface by the electric field $(\frac{1}{2})E$ on the interface region, increases since it is proportional to the second power of the electric field E. This Maxwell stress also acts as the induction acting force to restrain the instability. In this case, the lines of electric force M are gradually narrowed since the charges in the liquid are rearranged at the finite rate so as to establish the steady electric field which satisfies the equation $\Delta\phi=0$, which will be explained later. Consequently, by use of the relaxation time $t_c$, which is expressed as $\epsilon/\sigma$, and is the time required for the rearrangement of charges, or in other words, the time for the ions generated within the medium by means of the electric field to move to their respective electrodes, the effect of the electric field (the change of $(\frac{1}{2})(\epsilon_l-\epsilon_v)E^2$) reaches its maximum value.

In the following, the magnitude of each term will be obtained.

First, pressure $\Delta P_\gamma$ by the surface tension is obtained from $$\Delta P_\gamma = -\gamma \frac{\partial^2 \eta}{\partial x^2}$$

and it is given by $$\Delta P_\gamma = +\gamma \cdot Bk^2 \sin k\,(x-ct).$$

Thus, the difference $\Delta P_s$ of static pressure between the liquid and gas in the form of fluid is obtained by $$\Delta P_s=(\Delta P_l-\Delta P_v).$$

Further, the electric force $\Delta P_e$ exerted on the interface is obtained from the variation in magnitude of $\{\frac{1}{2}(\epsilon_l-\epsilon_v)E^2\}$ resulting from the deformation of the interface. ($\epsilon$: dielectric constant, E: intensity of electric field). The value of Maxwell stress is obtained from the continuous formula of current. That is, since the realtion div $J=\sigma\Delta\phi=0$ (J: current density, $\sigma$: conductivity, $\phi$: potential) is realized within the liquid, then if $$\Delta\phi = \frac{\partial^2\phi}{\partial x^2} + \frac{\partial^2\phi}{\partial y^2} = 0$$

is solved under the boundary condition below $$\frac{\partial\phi}{\partial x} \text{ when } y = -\infty = -Eo,$$

$$\frac{\partial\phi}{\partial y} \text{ when } y = 0 = -Eo\frac{d_y}{d_x} = -EoBk\cos k\,(x-ct)$$

then the potential $\phi$ is obtained by $$\phi=-Eox-EoBe^{-ky}\cos k\,(x-ct).$$

From the above, $$E^2=E_x^2+E_y^2\simeq E_b^2\{1-2B\,k\sin k\,(x-ct)\}$$

and the variation of Maxwell stress is obtained by $$\Delta P_l=\Delta\{\tfrac{1}{2}(\epsilon_l-\epsilon_v)E^2\}=-(\epsilon_l-\epsilon_v)\,E_o^2\cdot B\cdot k\sin k\,(x-ct).$$

From the above, the balance of the pressure in the gas-liquid interface obtained is that if the relation of $\Delta P_s \geqq \Delta P_e+\Delta P_\gamma$ is present, the variation of the interface is further amplified and therefore the instability occurs. Thereby, the relation of $\Delta P_s=\Delta P_e+\Delta P_\gamma$ provides the critical condition for occurrence of instability.

When the term B k sin k (x−ct) is erased from both sides given below $$\{\rho_l k\,(C-U_l)^2+\rho_v k\,(C-U_v)^2\}B\sin k\,(x-ct) = +(\epsilon_l-\epsilon_v)E_o^2 B\,k\sin k\,(x-ct)+\gamma B\,k^2\sin(x-ct)$$

to obtain the value of the wave propagation speed, then $$C=\frac{\rho_l U_l+\rho_v U_v}{\rho_l+\rho_v}\pm\sqrt{\frac{1}{\rho_l+\rho_v}\left\{\frac{2\pi\gamma}{\lambda}+(\epsilon_l-\epsilon_v)E_b^2\right\}-\frac{\rho_l\rho_v}{(\rho_l+\rho_v)^2}(U_l-U_v)^2}$$

using $k=2\pi/\lambda$ also. The wave propagtion speed corresponds to one when the value in the square root in the second term on the right side is negative because said propagation speed has no actual root when the instability occurs. From this, the maximum value of the relative speed of the vapor is expressed by $$(U_l-U_v)^2=\frac{(\rho_l+\rho_v)}{\rho_l\rho_v}\{2\sqrt{(\rho_l-\rho_v)g\gamma}+(\epsilon_l-\epsilon_v)E_b^2\}$$

and from $U_l\simeq 0$, the vapor speed $U_v$ is given by

Next, the variation of static pressure of the fluid is obtained using the Bernoulli's theorem. That is, the pressure change $\Delta P_l$ on the liquid side and the pressure change $\Delta P_v$ on the vapor side are respectively obtained follows:

$$\Delta P_l=\rho_l k\,(c-U_l)^2 B\cdot\sin k\,(x-ct)$$

$$\Delta P_v=-\rho_v k\,(c-U_v)^2 B\cdot\sin k\,(x-ct)$$

($U_l$: speed of liquid, $U_v$: speed of gas)

$$U_v \approx \sqrt{\frac{(\rho_l + \rho_v)}{\rho_l \rho_v} \{2\sqrt{(\rho_l - \rho_v)g\gamma} + (\epsilon_l + \epsilon_v)E_o^2\}}\ .$$

It is found from the above that the maximum heat flux (gc)E when the electric field is applied is greater than the maximum heat flux (gc) E=0 when the electric field is not applied through $$\frac{(q_c)E}{(q_c)E=0} = \sqrt{1 + \frac{(\epsilon_l - \epsilon_v)E_o^2}{2\sqrt{(\rho_l - \rho_v)g\gamma}}}\ .$$

Figure 7:
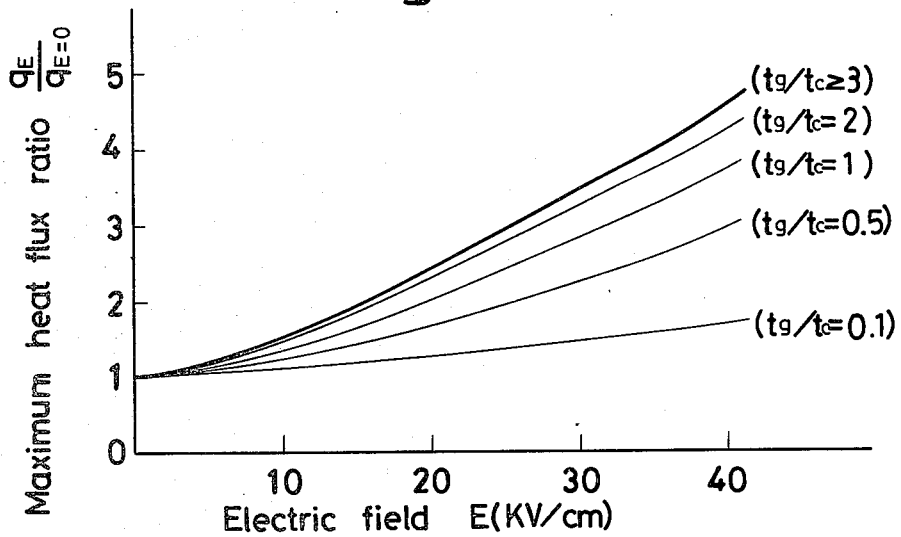
FIG. 7 is a characteristic curve showing the maximum value of the heat flux of Freon 113 obtained by theoretical analysis.
Figure 8:
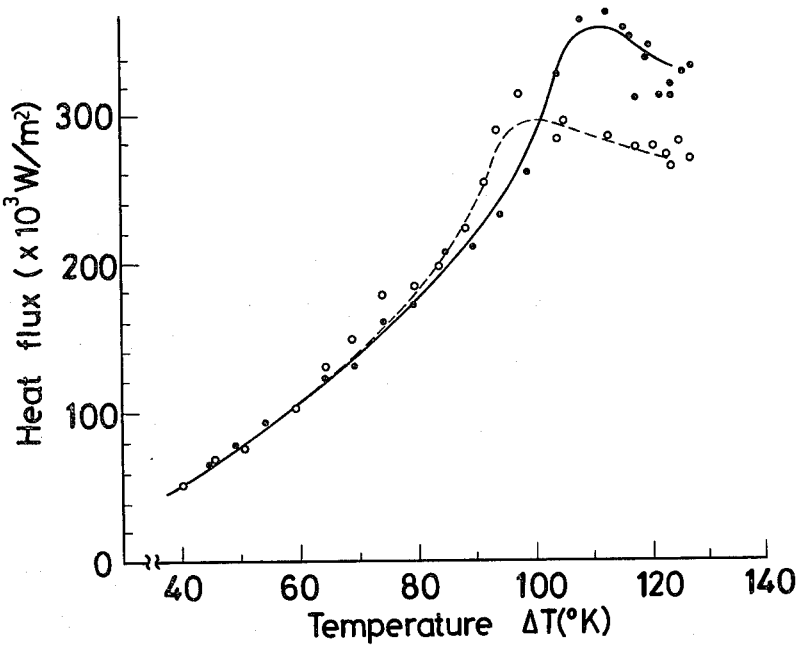
FIG. 8 is an actually measured boiling curve of Freon 113.

FIG. 7 shows the aforesaid relation. In FIG. 7, the vertical axis indicats the ratio of the maximum heat flux obtained when the electric field is not applied to that obtained when the field has been applied, and the horizontal axis indicates the intensity of the electric field. For example, when a heat exchange medium where the ratio between the characteristic time $t_g$ and the relaxation time $t_c$ exceeds 3 is used and an electric field of 30 Kv/cm is applied, the maximum heat flux is enhanced by about three times. FIG. 8 shows one example of the measured result of the boiling curve obtained from the experiment using Freon 113. It is found from the graph of FIG. 8 that when the electric field of 20 Kv/cm is applied, the maximum heat flux which is a peak of the boiling curve increases by about 20% as compared with the case (broken lines) where no electric field is applied, and the curve qualitatively explains the result of the aforementioned theoretical analysis.

In the aforementioned theoretical analysis, the relaxation time $t_c$ of the electric charge is considerably small as compared with the characteristic time $t_g$ with respect to the motion of bubbles, and the electric field is always the maximum preceding the change in motion of bubbles.

The relaxation time $t_c$ of the electric charge is then given by $$t_c = \frac{\epsilon}{\sigma}$$

and the relaxation time in case of Freon 113 is about 1 sec.

On the other hand, the characteristic time $t_g$ (forming interval of bubbles) with respect to the motion of bubbles is 10 to 50 msec., and therefore, the electric field does not become intensified until the value is obtained by solving the current preservation law. This results in a quantitative difference between the theoretical value and experimental value.

This means without doubt that when the relaxation time $t_c$ of the electric charge of the heat exchange medium to be used is made to be equal to or smaller than the characteristic time $t_g$ with respect to the motion of bubbles of the heat exchange medium, the maximum boiling heat flux may be increased to the maximum. When the intensity of the electric field is obtained by the following equation in the aforementioned theoretical analysis in order to insure the aforesaid effect, it is found that in the heat exchange medium which is different in $t_g/t_c$ value, the maximum heat flux ratio is different even in an electric field of the same strength.

$$\phi = -Eox - EoBe^{+ky}\, e^{-\frac{ig}{tc}} \cos k\,(x - ct)$$

That is, as shown in FIG. 7, when the $t_g/t_c$ value of the heat exchange medium is small, the effect of the electric field is small but when the ratio exceeds 1, the effect thereof remarkably appears.

However, when the relaxation time $t_c$ is made to be excessively smaller than the characteristic time $t_g$, the quantity of electric power used excessively increases, and therefore, the desirable range in practical use is that the relaxation time $t_c$ is about $\frac{1}{3}$ of the characteristic time $t_g$, that is, $t_g/t_c$ is about 3.

The relaxation time of the electric charge of the heat exchange medium may be reduced by increasing electric conduction $\sigma$.

More specifically, the characteristic time $t_g$ of bubble motion is on the order of about 25 msec., and thus, if the relaxation time $t_c$ of the electric charge is made to be 8 msec., the heat exchange medium where the $t_g/t_c$ value is about 3 may be obtained. In the case that Freon is used as the heat exchange to which alcohol is added to control the relaxation time of the electric charge, and for example, if Freon 113 is used as Freon and ethanol is used as alcohol, the property values of Freon 113 are that the permittivity $\epsilon$ is $2.1\times10^{-11}$ C/V.m and electric conductivity $\sigma$ is $1\times10^{-10}\Omega^{-1}.m^{-1}$ whereas the property values of ethnaol are that the permittivity $\epsilon$ is $2.2\times10^{-10}$ C/Vm and electric conductivity $\sigma$ is $6\times10^{-8}\ \Omega^{-1}.m^{-1}$. Also, the relaxation time $t_c$ of the electric charge is defined to be the value obtained by dividing the permittivity by the electric conductivity. Accordingly, a mixed liquid when a certain value (x%) of Freon 113 and ethanol is added has the permittivity $\epsilon$ and electric conductivity $\sigma$ obtained by the following equations:

$$\epsilon = 2.1 \times 10^{-11} \times \left(1 - \frac{x}{100}\right) + 2.2 \times 10^{-10} \times \frac{x}{100}$$

$$\sigma = 1 \times 10^{-10}\left(1 - \frac{x}{100}\right) + 6 + 10^{-8} \times \frac{x}{100}$$

As described hereinbefore, $t_c=(\epsilon/\sigma)$, and when the quantity of addition of ethnaol in order that the relaxation time $t_c$ of the electric charge is made to be 8 msec., the quantity thereof is about 7%, and a mixed liquid in which 7% of ethnaol is added to Freon 113 has a $t_g/t_c$ value of 3. As described above, the heat exchange medium having the $t_g/t_c$ value in the range of 1 to 3 may be obtained by controlling the value of addition of ethnaol to Freon. It is to be noted that similar effect may be obtained even if methanol, propyl alcohol, or the like is used in place of ethanol.

It should be appreciated that electrode 4 are extended in the form of wire netting in a preselected spaced relation on the heat transfer surface 3 and an electric field is applied to the heat exchange medium located therebetween and having a controlled $t_g/t_c$ value, and in this case, the high voltage applied is in the range up to about 30 KV, which can be either AC or DC to achieve the effects as described hereinbefore.

Figure 9:
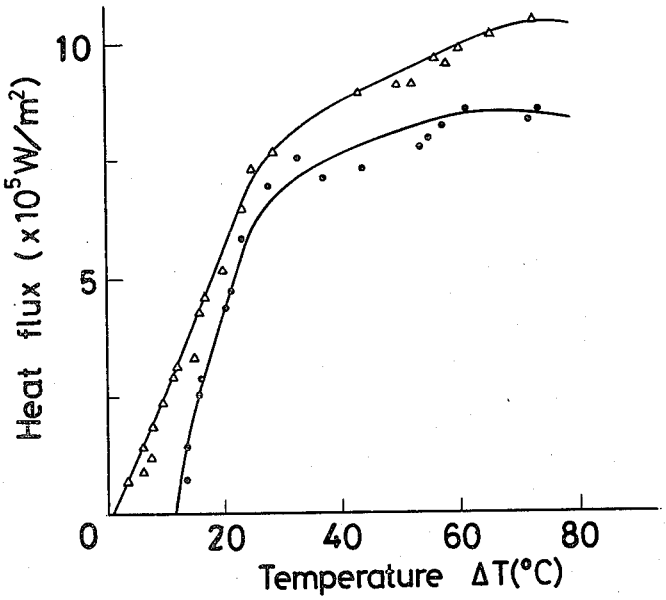
FIG. 9 is an actually measured boiling curve of the composite of Freon 113 and 7% ethanol.

As one example, a copper plate is used as a heat transfer plate, and wire netting of 5 meshes is used as an electrode and spaced by 0.5 mm from the copper heat transfer plate. As the heat exchange medium, a mixed liquid in which 7% of methanol is added to Freon 113 and a $t_g/t_c$ value of 3 is used. The heat transfer surface is the cathode and the wire netting is the anode, a DC voltage of 0—30 KV is applied, and the quantity of heat transfer and the boiling condition based on a temperature difference between the medium to be heated and the heat source are measured. The relationship between the quantity of heat transfer and the temperature difference as described above, when the applied voltage is 3 KV, is shown in FIG. 9. For reference, the relationship therebetween when the applied voltage is zero is shown by the curve designated by the solid circles O. It is apparent from the graph that when a voltage of 3 KV is applied, the heat exchange medium boils and heat begins to be transferred if the temperature difference between the heat source and the heat exchange medium is about 3 degrees. However, if no electric field is present, the heat transfer starts for the first time when the temperature difference is 12°. Further, the quantity of heat transfer is large, about $1\text{–}1.5\times10^5$ (W/m$^2$). Further, the spacing between the heat transfer surface and the wire netting electrode was varied from 0.5 mm to 10 mm to measure the relationship between them, and as a consequence it was found that with a spacing of 0.5–1.0 mm, there is created a force which bursts out bubbles from the heat transfer surface towards the outside of the wire netting electrode and the particularly remarkable effect appears and the heat transfer is considerably promoted over the entire region from the nucleate boiling to the film boiling. Moreover, the heat transfer surface is normally formed of a metal plate such as copper, stainless steel, or the like but the heat transfer effect is further promoted by use of the roughened heat transfer surface instead of the smooth heat transfer surface.

As described above, in accordance with the present invention, factors for increasing the maximum boiling heat flux to the greatest degree by the electric field are selected, and more specifically, the characteristics of the heat exchange medium not contemplated so far are varied or the distance between the heat transfer surface and the electrode is adjusted to further improve the maximum boiling heat flux by the electric field and even a small temperature difference between the medium from which heat is transferred and the heat exchange medium, boiling is effected to further enhance the maximum boiling heat flux effectively.

Obviously, many modifications and variations of the present invention are possible in light of the above teachings. It is therefore to be understood that within the scope of the appended claims, the present invention may be practiced otherwise than as specifically described herein.

What is claimed is:

1. A method for promoting boiling heat transfer, so as to maximize the maximum boiling heat flux, within a heat exchange medium which is disposed in contact with a heat transfer surface, comprising the steps of:

disposing an electrode a predetermined distance away from said heat transfer surface;

applying a high voltage to said electrode and said heat transfer surface so as to generate an electric field within said heat exchange medium; and using a heat exchange medium having an electric charge relaxation time $t_c$ and a characteristic time of the formation of bubbles $t_g$ such that the ratio $t_g/t_c$ is within the range of 1–3, whereby for a particular value of applied voltage and the resulting electric field, said maximum boiling heat flux is maximized.

2. A method of boiling heat transfer according to claim 1 wherein said heat exchange medium is a mixed liquid in which about 7% of ethanol is added to Freon.

3. A method of boiling heat transfer according to claim 1 wherein the electrode comprises a wire netting electrode.

4. A method of boiling heat transfer according to claim 3 wherein a spacing of from 0.5 to 1.0 mm is provided between the heat transfer surface and the wire netting electrode.

* * * * *